United States Patent [19]

Matthews

[11] Patent Number: 4,953,246

[45] Date of Patent: Sep. 4, 1990

[54] CUBICLE BED

[76] Inventor: O. H. Matthews, 230 Okemah Trail, SE., Marietta, Ga. 30060

[21] Appl. No.: 503,628

[22] Filed: Apr. 2, 1990

[51] Int. Cl.[5] ..... A61G 7/06

[52] U.S. Cl. ..... 5/424; 5/8; 5/425; 5/512

[58] Field of Search ..... 5/8 R, 93 R, 280, 284, 5/424, 425, 512

[56] References Cited

U.S. PATENT DOCUMENTS

| | | | |
|---|---|---|---|
| 2,477,231 | 7/1949 | Bourdon | 5/93 R |
| 2,657,399 | 11/1953 | Rochford | 5/8 |
| 4,017,917 | 4/1977 | Brown | 5/284 X |
| 4,571,904 | 2/1986 | Kessler et al. | 5/93 R X |
| 4,641,387 | 2/1987 | Bondy et al. | 5/284 X |
| 4,672,698 | 6/1987 | Sands | 5/424 |
| 4,843,788 | 7/1989 | Coavin et al. | 5/93 R X |

FOREIGN PATENT DOCUMENTS

| | | | |
|---|---|---|---|
| 2107977 | 5/1983 | United Kingdom | 5/8 |

OTHER PUBLICATIONS

Craig Bed Construction Plan, Author Tim Pennington, 3.30.1989.

*Primary Examiner*—Michael F. Trettel
*Attorney, Agent, or Firm*—Charles J. Prescott

[57] ABSTRACT

A cubicle bed for protectively confining a traumatically brain injured patient or the like. The cubicle bed includes a two-part rectangular base having a padded upper surface atop which the patient rests and also includes removable upright padded end panels connectable to each end of each part of the base and pivotally openable and removable padded side doors. The end panels and doors, when in place and closed, form a fully padded perimeter wall around the edges of the base which are sized in height above the base so that the patient's view of the surrounding activity outside the cubicle bed is limited.

11 Claims, 3 Drawing Sheets

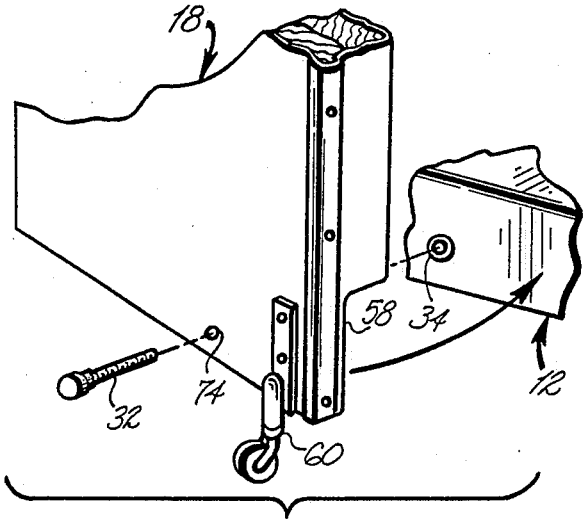
Fig. 8
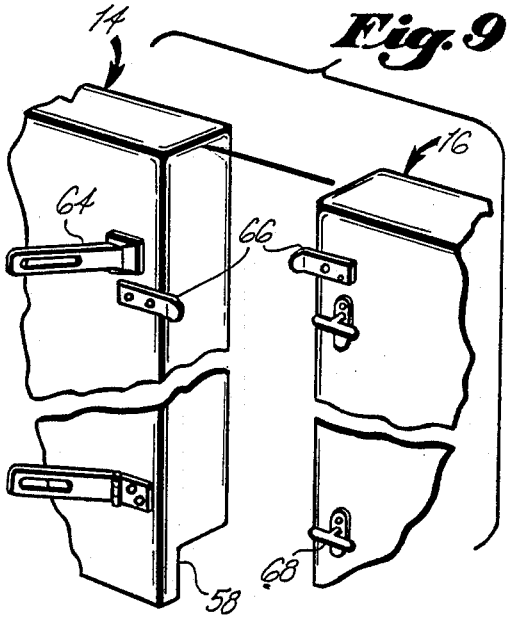
Fig. 9
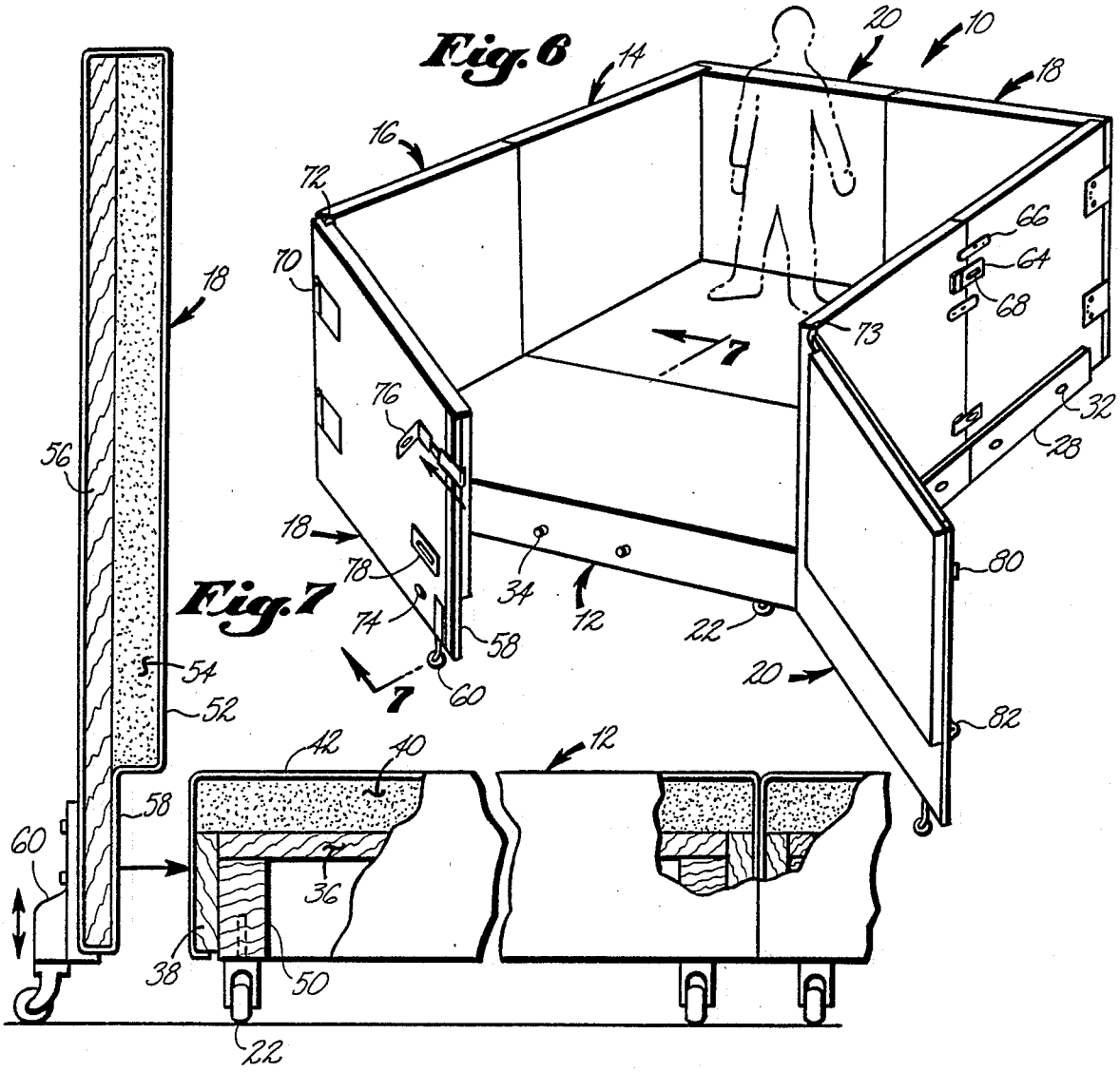
Fig. 6
Fig. 7

CUBICLE BED

BACKGROUND OF THE INVENTION

The invention relates generally to hospital equipment, and more particularly to a cubicle bed for traumatically brain injured patients.

As traumatically brain injured patients emerge from coma, there may be transitory periods of agitation during which they pull at feeding tubes and intravenous catheters and thrash about. Such activity puts them at risk of injury, requiring the nursing staff to resort to some form of restraint.

These restraints fall generally into three categories. First, conventional physical restraints of body limbs and movement, such as the vest and wrist types, may be used to control behavior and prevent injury. However, these restraints are offensive to patients, families and staff and are also time consuming to apply and remove. Most hospital policies specify that, when using physical restraints, patients must be checked every 15 minutes to assess the restraint's continued need and proper use. Some studies have indicated that physical restraints, however, tend to increase the very behavior that is intended to be controlled.

Harmful agitation in the traumatically brain injured patient may also be managed by chemical means. However, cognitive recovery may be impaired by some chemicals due to sedation and disruption of the memory process, may inhibit the patient's ability to learn, and may lengthen the periods of agitation. Other chemical restraints may produce memory, attention and concentration disturbances. The use of pharmaceuticals to control such agitation has not been well studied nor has the effect of these drugs on cognitive recovery been thoroughly investigated.

A third form of restraint for traumatically brain injured patients is to provide a modified environment that allows for safe expression of the behavior. One early device was used at Craig Hospital in Denver, Colorado. The Craig device resembles a large padded play pen in to which the client was placed free to thrash about. It was designed to control external audible and visible stimulation and to provide a safe environment for traumatically brain injured patients.

The present invention provides for a novel cubical bed separable into two generally equal halves and having openable and removable side portions made up of mating hinged removable doors, as well as removable end panels. The entire device is lockable together into an assembly which may be moved and transported and which allows for convenient alternate modes of access to the patient by medical staff.

BRIEF SUMMARY OF THE INVENTION

This invention is directed to a cubicle bed for protectively confining a traumatically brain injured patient or the like. The cubicle bed includes a two-part rectangular base having a padded upper surface atop which the patient rests and also includes removable upright padded end panels connectable to each end of each part of the base and pivotally openable and removable padded side doors. The end panels and doors, when in place and closed, form a fully padded perimeter wall around the edges of the base which are sized in height above the base so that the patient's view of the surrounding activity outside the cubicle bed is limited. Various access modes are provided for patient care.

It is therefore an object of this invention to provide a uniquely structured cubicle bed for protectively confining a traumatically brain injured patient or the like therewithin.

It is another object of this invention to provide a cubicle bed which has a wide versatility both in terms of access to the patient for nursing care, as well as very convenient deployment, dismantling and transporting within a hospital setting.

In accordance with these and other objects which will become apparent hereinafter, the instant invention will now be described with reference o the accompanying drawings.

BRIEF DESCRIPTION OF THE DRAWINGS

FIG. 6 is a perspective view of the invention showing one set of doors in their partially open position for access to provide patient care.

FIG. 7 is a section view in the direction of arrows 7—7 in FIG. 6.

FIG. 8 is an enlarged perspective view of the lower inner corner of one door ad the base.

FIG. 9 is an enlarged perspective view of two mating end panels of the invention.

DETAILED DESCRIPTION OF THE INVENTION

Figure 1:
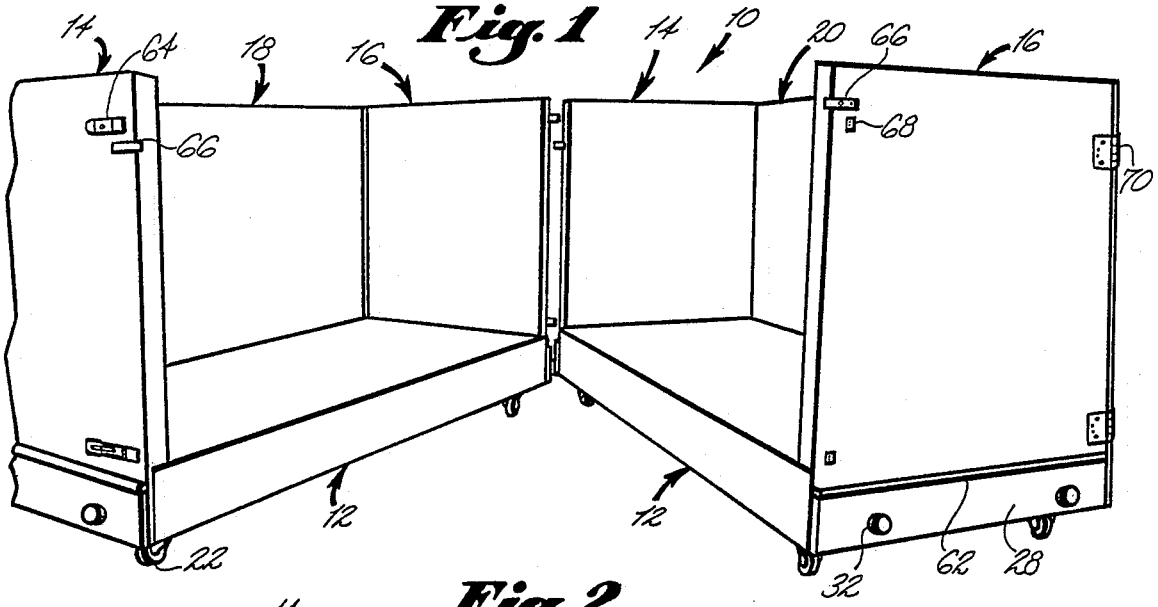
FIG. 1 a perspective view of the invention in one open position by the separation of the base portions to provide access for patient care.
Figure 2:
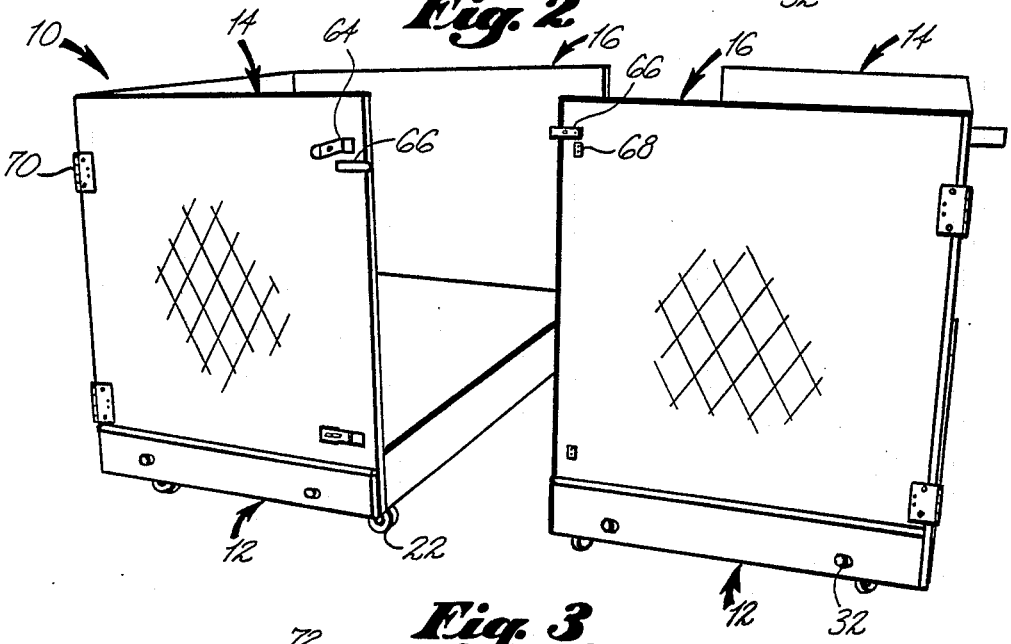
FIG. 2 is a perspective view similar to FIG. 1 with the base portions completely separated and spaced apart.

Referring now to the drawings, the invention is shown generally at numeral 10 in FIGS. 1, 2 and 6. The invention 10 includes a pair of mating rectangular bases 12, rectangular removable upright end panels 14 and 16, and pivotally connected, removable doors 18 and 20 which form upright side panels. All interior surfaces are padded with a two inch layer of foam and covered with a suitable layer of naugahyde or the like.

Figure 5:
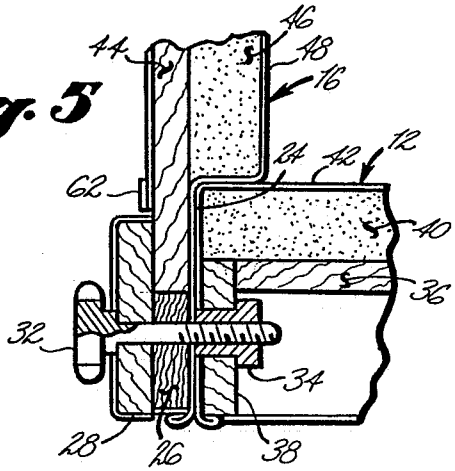
FIG. 5. is a section view in the direction of arrows 5—5 in FIG. 4.
Figure 4:
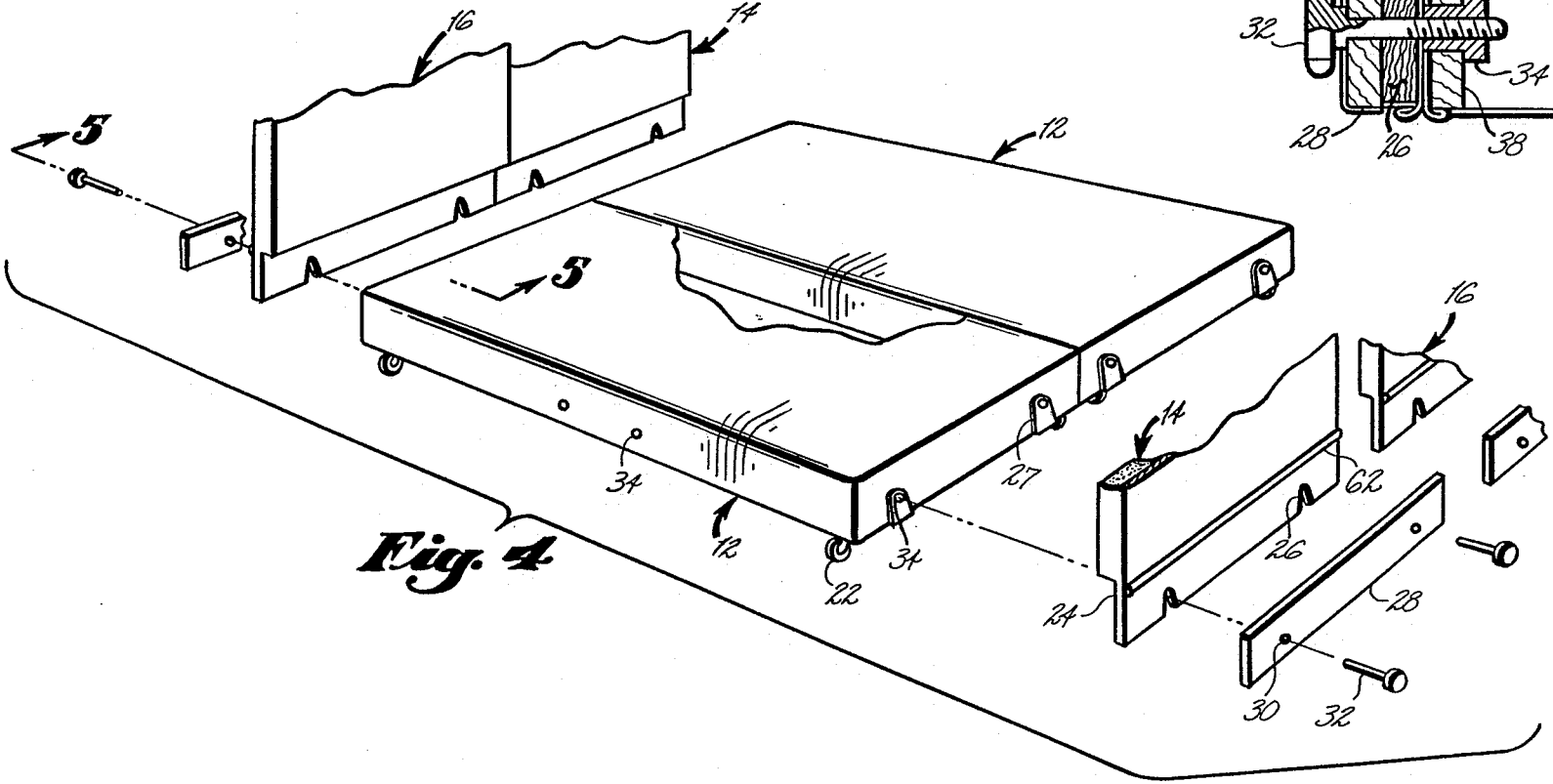
FIG. 4 is an exploded perspective view of the base and lower portions of the end panels.

Referring particularly to FIG. 4 and 5, the detachable connection between the end panels 14 and 16 and the base portions 12 is there depicted. As best seen in FIG. 5, each base portion 12 is constructed having a horizontal reinforced plywood support panel 36 which is rigidly connected to an elongated edge-upright wood frame portion 38. A layer of compressible foam, approximately two inches in thickness is disposed atop horizontal support panel 36. Thereafter, the entire arrangement is surrounded by a layer of naugahyde 42 or the like. Each end panel 14 and 16 is constructed having a plywood main panel 44 and a two-inch compressible foam layer 46 on the interior surface, all wrapped with a layer of Naugahyde.

Each base portion 12 is supported on casters 22 so that the entire arrangement will be rollable and so that sufficient clearance is provided between each base portion 12 and the floor for access for patient lifting equipment such as a Hoya lift.

Each end panel 14 and 16 includes two spaced notches 26 which are generally of an inverted V-shape and upwardly extend from the lower margin of the end panels 14 and 16. A recess 24 is also provided along the lower margin of each end panel 14 and 16 by deletion of foam there. Also provided is a lower support plate 28 having apertures formed therein which are shaped to supportively engage atop spaced support wedge blocks 27 connected to the end surfaces of each base portion 12. The lower support plate 28 is structured to mate against the outer surface of the end panels 14 and 16 as best seen in FIG. 5. Threaded fasteners 32 are also provided which pass through apertures 30, and threadably engage into threaded female connectors 34 which are embedded or otherwise secured into frame portion 38. Thus, by this arrangement, fasteners 32 having an enlarged exposed end for hand grasping, may be passed through apertures 30 in lower support plate 28 and partially threaded into connectors 34 while wedge blocks 27 receive the full weight of each end panel 14 and 16 thereupon within notches 26. Thereafter, further hand tightening of fasteners 32 sandwiches or squeezes the lower ends of end panels 14 and 16 securely into place in upright fashion at each end of base portion 12.

An additional horizontal rib 62 may also be provided connected to each end panel 14 and 16 to engage against lower support plate 28 to bear some of the weight of end panels 14 and 16.

Referring particularly to FIG. 9, to further strengthen the interconnection between the upright end panels 14 and 16 and the end of base portion 12, alignment straps 66 are also provided. These alignment straps 66 are rigidly connected to each end panel 14 and 16 in alternate opposing fashion as shown. When the end panels 14 and 16 are brought together in side-by-side abutting relation, the two alignment straps 66 cooperate to prevent relative lateral movement between the end panels 14 and 16. A convention hasp including a hinged metal strap 64 which matably engages over a rotatable staple 68 to cooperate in the conventional way as shown in FIG. 9 are also provided to lock the two halves of the cubicle bed 10 together.

Referring now to FIGS. 6, 7 and 8, castors 22 are supportively mounted within a mating cavity formed within an additional frame portion 30 which extends on the inboard side of each frame member 38. A threaded female connector 34 as previously described is also provided along the edges of base portions 12 so as to threadably receive a separate threaded fastener 32 which may be passed through aperture 74 and threadably aligned into connector 34 of hinged doors 18 and 20. These doors 18 and 20 are removably connected by suitable hinges 70 so that the doors 18 and 20 may be individually openable and completely removable from the mating hinge portion of hinge 70 connected to end panels 14 and 16.

The layer of compressible foam 54 against main plywood panel 56 of each door 18 and 20 extends from the upper horizontal margin of each door 18 and 20 down toward but not the lower margin of the plywood panel 56 so that notch 58 is formed as best seen in FIG. 7. This notch 58 is structured so as to mate around the edge of base portions 12 to provide a more complete, uniform padding along these corners when the doors 18 and 20 are in the closed position.

To reduce the supportive stress placed on end panels 14 and 16, doors 18 and 20 also include spring biased castors 60 which are connected adjacent the mating upright margins of these doors 18 and 20. These castors 60 are spring biased so that the doors 18 and 20 may open and close freely over uneven floor surfaces without further undue distress placed upon end panels 14 and 16.

In addition to providing threaded fastener 32 fitted through aperture 74 in the lower margin of each door 18 and 20, additional closure means is also provided in the form of a conventional latch bolt 78 which matably engages within clasp 82 and latch 76 which engages within clasp 80 to pull and forcibly urge the mating inner margins of each door 18 and 20 together in the direction of the arrow. Note that vertical notches 72 and 73 along the outer upright margins of each door 18 and 20 are also provided so as to provide a more uniform upright padded corner when the doors 18 and 20 are in the closed position in a fashion similar to that described with respect to notch or recess 58 against base portions 12.

Having now described the nature and specific components and the connecting and hinge means associated therewith, the versatility and usefulness of the invention 10 may now be more fully understood when referring to FIGS. 1, 2, 3, and 6. In FIGS. 1 and 2, the ease of separating the two base portions 12 while maintaining the end panels 14 and 16 and doors 18 and 20 fully in place is there shown. Thus, when either attending to a patient positioned therewithin or in moving the entire arrangement 10 from one location to another within a hospital, detachment and separation of base portions 12 is easily facilitated. Note that base portions 12 have a plan size and shape which is similar to that of other beds and stretchers within a hospital so that when separated as shown in FIGS. 1 and 2, these two separate fully assembled halves of the invention 10 may be easily moved down a hallway or into and out of hospital rooms.

Figure 3:
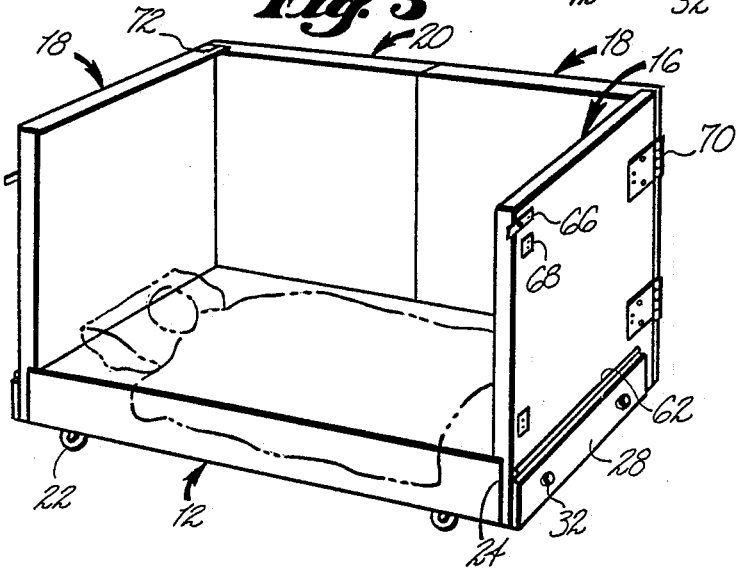
FIG. 3 is a perspective view of one half of the invention shown in FIG. 1.

In addition to being able to care for a patient contained in the present invention by simply separating the base portions 12 as shown in FIGS. 1, 2 and 3, nursing care may also be provided by opening either or both of the doors 18 and 20 as shown in FIG. 6. In many cases, the patient's activity and level of violence may dictate the particular use of one of these modes of access.

Typically a traumatically brain injured patient exhibits very violent behavior. In many cases this violent behavior may injure the patient in some fashion if suitable padding is not provided. Therefore, it is stressed that all inner surfaces with which a patient contained in the present invention may come in contact are fully padded with a suitable layer of compressible foam.

Additionally, to avoid any undue external stimulus to the patient, the uniform height of the side and end panels 14 and 16 and doors 18 and 20 is such that the patient is unable to observe normal ongoing activity around the cubicle bed 10 although medical staff may still stand adjacent and outside of the cubicle bed so as to observe the patient's activity.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cubicle bed for protectively confining a traumatically brain injured patient comprising:

a horizontal rectangular base having two connectable generally equally sized rectangular base portions with generally coplaner padded upper surfaces;

an upright removable end panel having a padded interior surface connected to, and upwardly extending from, each of the ends of said base portions;

two said end panels connectably positionable in side-by-side relationship at each end of each said base;

a removable upright side door having a padded interior surface pivotally connectable along a mating upright margin of each said end panel at each corner of said base;

two said upright side doors forming a side panel along each side of said base when closed;

said end panels and said side doors, when closed, forming a padded upright enclosure extending upwardly to form a generally horizontal upper perimeter for confining the patient therewithin atop said base;

said upper perimeter positioned sufficiently high above said base to restrict viewing of normal activity and surroundings adjacent said cubicle bed by the patient.

2. A cubicle bed as set forth in claim 1, further comprising:

support wheels for each said base portion whereby each said base portion is elevated above the floor and is easily repositionable separately or when connected one to another.

3. A cubicle bed as set forth in claim 2, further comprising:

a spring biased support wheel connected to the unsupported lower corner of each said door, said spring biased support wheel sized to reduce the load acting upon the pivotal connection between each said door and said end panel.

4. A cubicle bed as set forth in claim 3, wherein:

each said base portion is sized for convenient rollable movement within corridors and in to and out of rooms in hospitals.

5. A cubicle bed as set forth in claim 3, further comprising:

rigid end panel alignment straps connected to each said end panel, each said alignment strap acting upon the corresponding adjacent said end panel to maintain a coplaner relationship between said end panels positioned in said-by-side relationship at each end of said base.

6. A cubicle bed as set forth in claim 3, wherein:

said end panels and said side doors are lockable in a closed relationship whereby the patient is protectively confined within said cubicle bed.

7. A cubicle bed as set forth in claim 3, further comprising:

door bolts connectable to the edge of said base through a hole in each said door to maintain said doors in a closed position.

8. A cubicle bed as set forth in claim 3, further comprising:

rigid end panel alignment straps connected to each said end panel, each said alignment strap acting upon the corresponding adjacent said end panel to maintain a coplaner relationship between said end panels positioned in said-by-side relationship at each end of said base;

each said base portion is sized for convenient rollable movement within corridors and in to and out of rooms in hospitals;

said end panels and said side doors are lockable in a closed relationship whereby the patient is protectively confined within said cubicle bed.

9. A cubicle bed as set forth in claim 8, further comprising:

a plurality of inverted generally V-shaped notches formed into and upwardly extending from the lower margin of each said end panel;

a lower support plate positionable along and against the lower portion of each said end panel;

a threaded fastener for supporting each said end panel on each of said plurality of notches and connectable through a hole in said lower support plate which is threadably engagable into the edge of said base;

each said end panel lower portion squeezably supported between one said lower support plate and the edge of said base when said fasteners are tightened.

10. A cubicle bed as set forth in claim 2, wherein:

said cubicle bed is structured for separation between said base portions when said end panels and said doors remain closed for patient care access.

11. A cubicle bed as set forth in claim 2, wherein:

said cubicle bed is structured for opening of at least one said door for patient care access while said end panels and the other said doors remain closed and said base portions remain together.

* * * * *